US005699076A

United States Patent [19]

Tomiyasu

[11] Patent Number: 5,699,076

[45] Date of Patent: Dec. 16, 1997

[54] DISPLAY CONTROL METHOD AND APPARATUS FOR PERFORMING HIGH-QUALITY DISPLAY FREE FROM NOISE LINES

[75] Inventor: Yuichi Tomiyasu, Tokyo, Japan

[73] Assignee: Kabushiki Kaisha Toshiba, Kawasaki, Japan

[21] Appl. No.: 327,643

[22] Filed: Oct. 24, 1994

[30] Foreign Application Priority Data

Oct. 25, 1993 [JP] Japan ..... 5-266090
Sep. 19, 1994 [JP] Japan ..... 6-222864

[51] Int. Cl.[6] ..... G09G 3/36

[52] U.S. Cl. ..... 345/103; 345/98; 345/99; 345/93

[58] Field of Search ..... 345/103, 94, 88, 345/89, 96, 98, 99, 100; 359/54, 55; 349/33, 34, 37

[56] References Cited

U.S. PATENT DOCUMENTS 4,679,043 7/1987 Morokawa ..... 345/103
5,138,305 8/1992 Tomiyasu ..... 345/3
5,309,168 5/1994 Itoh ..... 345/98
5,512,915 4/1996 Leroux ..... 345/103

FOREIGN PATENT DOCUMENTS 62-122387 6/1987 Japan .
4-493 1/1992 Japan .
5-158432 6/1993 Japan .

*Primary Examiner*—Xiao Wu
*Attorney, Agent, or Firm*—Finnegan, Henderson, Farabow, Garrett & Dunner, L.L.P.

[57] ABSTRACT

During a vertical blank period, in order to prevent generation of noise lines, a display controller outputs the same video data FVD as that of a display final line as dummy data of a vertical blank period start line, and outputs, in advance, video data to be displayed on a display start line in the next frame cycle as dummy data of a vertical blank period final line. The display controller also output a shift clock together with these dummy data. As a result, both upon a change from the display period to the vertical blank period and upon a change from the vertical blank period to the display period, a video data value difference can be eliminated, and generation of noise lines can be prevented.

8 Claims, 16 Drawing Sheets

| CONTROLLER OF TYPE 2 | DISPLAY DATA PATTERN | DISPLAY SCREEN |
|---|---|---|
| DUMMY DATA = "0" | WHITE (ALL PIXELS = ON) | BLACK LINE IS GENERATED IN UPPER MIDDLE AND LOWER PORTION OF SCREEN |
| | BLACK (ALL PIXELS = OFF) | NO BLACK LINE IS GENERATED |
| DUMMY DATA = "1" | WHITE (ALL PIXELS = ON) | NO WHITE LINE IS GENERATED |
| | BLACK (ALL PIXELS = OFF) | WHITE LINE IS GENERATED IN UPPER MIDDLE AND LOWER PORTION OF SCREEN |

HORIZONTAL SCANNING PERIOD

1st LINE
2nd LINE

3rd LINE

STORAGE OF UPPER PANEL DATA
DISPLAY OF UPPER AND LOWER DATA
UPPER PANEL 1st LINE

LOWER PANEL 1st LINE

479th LINE
480th LINE

UPPER PANEL 240th LINE

LOWER PANEL 240th LINE

DISPLAY CONTROL METHOD AND APPARATUS FOR PERFORMING HIGH-QUALITY DISPLAY FREE FROM NOISE LINES

BACKGROUND OF THE INVENTION

1. Field of the Invention

The present invention relates to a display control method and apparatus for controlling a flat panel display such as a liquid crystal display (LCD) and the like used as a display monitor for a personal computer, and more particularly, to a display control method and apparatus suitable for control of an LCD constituted by two, upper and lower panels.

2. Description of the Related Art

In general, as display monitors for compact personal computers such as notebook type computers and lap-top type computers, flat panel displays such as color and monochrome LCDs and the like are used. These LCDs are roughly classified into a simple matrix type and an active matrix type.

In a simple matrix type LCD, pixels of a TN or STN liquid crystal layer are defined by overlapping regions between common electrodes arranged at one side of the liquid crystal layer and segment electrodes arranged at the other side of the layer. The common electrodes sequentially receive a drive signal. The segment electrodes parallelly receive a data signal corresponding to video data set in a line buffer of the LCD. Each pixel of the LCD is addressed by the drive signal supplied to the common electrodes and the data signal supplied to the segment electrodes.

The simple matrix type LCD allows a higher manufacturing yield than that of the active matrix type LCD which utilizes nonlinear switching elements such as TFTs, and can be realized with low cost. For this reason, compact personal computers which require lower prices often utilize the simple matrix type LCD.

However, the simple matrix type LCD easily causes a crosstalk phenomenon owing to its physical structure, and this phenomenon decreases the contrast, thus impairing display quality. Since the decrease in contrast is promoted as the duty ratio (1/N; N is the number of common electrodes in a panel) becomes lower, display quality becomes lower as the LCD includes a larger number of common electrodes in the panel.

In order to solve this problem, most of recent simple matrix type LCDs have two panels constituting a screen. One panel corresponds to the upper half screen portion, and the other panel corresponds to the lower half screen portion. For example, in an LCD which supports a 640 (dots)×480 (lines) display screen, the upper half screen portion is displayed by an upper panel having a 640 (dots)×240 (lines) dot matrix, and the lower half screen portion is displayed by a lower panel having a 640 (dots)×240 (lines) dot matrix. In this case, one line of the upper panel and one line of the lower panel are simultaneously addressed, and a display operation is performed in units of two lines. For this reason, the 640 (dots)×480 (lines) display screen can be display-controlled at a duty ratio of 1/240. As a result, the contrast problem can be solved, and a high-quality display can be realized.

A display controller for controlling an LCD having two, upper and lower panels of this type is roughly classified into the following three types depending on differences in vertical blank period control.

Type 1: a display controller which does not insert a vertical blank period in one frame-cycle period;

Type 2: a display controller which inserts a vertical blank period in one frame-cycle period, and transfers dummy data fixed to "0" or "1" to a line buffer of an LCD during the vertical blank period; and Type 3: a display controller which inserts a vertical blank period in one frame-cycle period, and stops data transfer to a line buffer of an LCD during the vertical blank period.

The conventional display controllers of types 1 to 3 respectively suffer the following problems.

[Type 1]

When the display controller of type 1 is used, the display period of the next frame is started immediately after the display period of a certain frame. Some application programs rewrite a color palette of the display controller by utilizing the vertical blank period. However, since there is no vertical blank period when the display controller of type 1 is used, the rewrite operation of the color palette and the display operation are executed to overlap each other, resulting in flickers on the screen.

[Type 2]

When the display controller of type 2 is used, since the vertical blank period is set, the above-mentioned problem can be solved. However, the display controller of type 2 suffers a phenomenon of black or white lines (to be referred to as noise lines hereinafter) displayed on the upper, middle, and lower portions on the screen. A black noise line is generated since a pixel which must be in an ON state in practice is changed from an ON state to an OFF state due to dummy data "0". On the other hand, a white noise line is generated since a pixel which must be in an OFF state in practice is changed from an OFF state to an ON state due to dummy data "1".

Such a change in ON/OFF state of a pixel occurs since dummy data "0" or "1" transferred to the LCD during the vertical blank period distorts the voltage waveform to be applied to the pixel on a display line immediately before and after the vertical blank period. FIG. 1 shows the relationship between the noise lines and the dummy data.

As shown in FIG. 1, when the dummy data is "0", if an all-white (all pixels are in an ON state) data pattern is displayed on a normally black LCD, black noise lines are displayed on the upper, middle, and lower display lines on the screen. On the other hand, if an all-black (all pixels are in an OFF state) data pattern is displayed on this LCD, no noise lines are displayed.

On the other hand, when the dummy data is "1", contrary to the above-mentioned case, no noise lines are generated if an all-white data pattern is displayed, and white noise lines are generated if an all-black data pattern is displayed.

FIG. 2 shows the generation positions of noise lines on the screen of the LCD constituted by the two panels. This LCD is a 640 (dots)×480 (lines) normally black monochrome LCD. The upper and lower panels are simultaneously controlled by an identical frame cycle including a display period and a vertical blank period (VBLANK).

When an all-white data pattern is displayed on the screen, as shown in FIG. 2, on the upper panel, black noise lines appear on display lines (lines 239 and 0) immediately before and after the vertical blank period (VBLANK). Similarly, on the lower panel, black noise lines appear on display lines (lines 479 and 240) immediately before and after the vertical blank period (VBLANK).

The black noise lines on lines 0 and 479 are not conspicuous since they are respectively located at the upper and lower portions on the screen. However, the black noise lines on lines 239 and 240 are very conspicuous since they are located at the middle of the screen and are present at neighboring positions.

Note that the noise lines are expressed as "black" and "white" lines for the sake of simplicity. However, in practice, these noise lines are displayed as medium-density halftone lines between black and white. When the entire display screen is in white, such lines appear black; when the entire display screen is in black, they appear white.

A cause of generation of noise lines will be explained below.

As described above, a noise line is generated due to a decrease in effective voltage, which is caused when the waveform of a voltage applied to pixels of a specific display line is distorted.

The waveform distortion occurs when a state wherein pixels in a certain line are ON and those in the next line are OFF or a state wherein pixels in a certain line are OFF and those in the next line are ON continuously appears for several frames. When such a state occurs, noise lines appear not only on display lines immediately before and after the vertical blank period but also on a display line in the middle of the display period.

However, on the actual display screen, a state wherein all pixels in a specific line are fixed to an ON or OFF state and all pixels in the next line are fixed to the other state continuously for a period of several frames rarely occurs. Since each pixel on the display screen normally changes from an ON state to an OFF state or vice versa several times during several frames, even when data "1" is given, the pixel is often displayed to have an intermediate value between the ON and OFF states. In this manner, on the display lines in the middle of the display period, since pixels actually display halftone lines between the ON and OFF states, medium-density halftone noise lines appearing thereon cannot be visually sensed by man.

On the other hand, during the vertical blank period, since data is fixed to "1" or "0", if display lines before and after the vertical blank period are continuously fixed to the state opposite to the data for a period of several frames, a value difference of video data during the blank period of the display lines increases, and hence, the above-mentioned noise lines are visually sensed by man.

[Type 3]

When the display controller of type 3 is used, transfer of video data to a line buffer of the LCD is stopped during the vertical blank period (VBLANK). For this reason, the line buffer of the LCD holds a display data pattern on display lines (lines 239 and 479) immediately before the vertical blank period (VBLANK) during the vertical blank period (VBLANK).

Therefore, on the upper panel, data on line 239 and data during the vertical blank period (VBLANK) become the same, and the above-mentioned noise line does not appear on line 239. However, when data on line 239 is different from that on line 0 in the next frame, the same phenomenon as that in the controller of type 2 occurs on line 0, and a noise line is generated there, as shown in FIG. 3. Similarly, on the lower panel, data on line 479 and data during the vertical blank period (VBLANK) become the same, and the above-mentioned noise line does not appear on line 479. However, when data on line 479 is different from that on line 240 in the next frame, a noise line appears on line 240 in the same manner as in the controller of type 2.

As described above, on the actual display screen, data on line 239 on the upper panel very rarely becomes the same as that on line 0 in the next frame, and in most cases, different data patterns are displayed on these lines. Also, data on line 479 on the lower panel very rarely becomes the same as that on line 240 in the next frame.

Therefore, when the controller of type 3 is used, noise lines appear on display lines (lines 0 and 240) immediately after the vertical blank period (VBLANK), as shown in FIG. 2.

As described above, in the conventional display controllers, noise lines are undesirably displayed on the screen of the flat panel display under the influence of dummy data during the vertical blank period upon a change from the display period to the vertical blank period or vice versa.

As a conventional control method of dual screen panels, a method of controlling the panels by arranging a frame buffer for half a screen, which buffer stores video data for the upper or lower panel, and a method of controlling the panels by alternately reading out upper or lower panel data in units of characters or bytes are known.

In the former method, a CRT control circuit and a video output circuit are operated at the same timing as a CRT output timing, and at the same time, video data is written in a non-display area of an external video memory. Upon completion of an operation for half a screen corresponding to the upper panel, video data for the lower panel is read out while reading out the video data (the video data for the upper panel) stored in the video memory, and is output to the LCD panels together with the video data for the upper panel. Similarly, the video data for the lower panel is stored in the video memory while being output. The data in the video data is rewritten to data for the upper and lower panels for every half screen. Since the upper and lower panels are operated at the CRT output timing, the LCD scans the same data for two frames in a time required for scanning the CRT for one frame.

In the latter method, the panels are controlled at a flat panel display timing different from the CRT output timing. Display addresses are alternately output to the upper and lower panels in units of characters or bytes to alternately read out data for the upper and lower panels, and the readout data are simultaneously output from the video output circuit to the LCD panels. Therefore, the upper panel commonly uses the CRT display circuit for the CRT, and the lower panel independently has the same circuit.

However, when the frame buffer for the upper or lower frame is allocated on a video memory area outside the display controller chip, a read/write memory cycle of this data is generated at the cost of the access frequency from the system, thus lowering the write speed of the video memory.

Similarly, when the frame buffer is allocated inside the display controller chip, the number of circuit elements considerably increases, and the chip area increases although no memory cycle is generated. In addition, since data are output to the LCD panel at the same timing as the CRT, i.e., at a speed twice the dual screen LCD timing, display quality deteriorates.

In the method of alternately reading/writing upper and lower panel data in units of characters or bytes, a circuit of a CRT controller including address control is complicated, and the number of circuit elements increases.

SUMMARY OF THE INVENTION

The present invention has been made in consideration of the above situation, and has as its object to provide a display control method and apparatus, which can prevent a phenomenon of noise lines displayed on the screen of a flat panel display, and can achieve high-quality display free from noise lines independently of data patterns to be displayed on the flat panel display.

It is another object of the present invention to provide a display control apparatus which can realize dual screen panel control with a simple circuit arrangement while maintaining a high rewrite speed of a video memory and high display quality.

According to the present invention, there is provided a display control apparatus for controlling a flat panel display in a frame cycle including a display period for a plurality of lines and a vertical blank period for at least two lines following the display period, comprising video data transfer means for sequentially transferring video data for a plurality of lines from a display start line to a display final line of the flat panel display to a line buffer of the flat panel display during the display period, means for setting contents of the line buffer during the vertical blank period immediately after the display final line to be the same as video data of the display final line, and means for setting contents of the line buffer during the vertical blank period immediately before the next frame cycle to be the same as video data to be displayed on the display start line in the next frame cycle.

In this display control apparatus, the contents of the line buffer on the display final line are set to be the same as the contents of the line buffer during the vertical blank period immediately after the display final line, and the contents of the line buffer on the display start line of the next frame cycle are set to be the same as the contents of the line buffer during the vertical blank period immediately before the display start line. For this reason, both upon a change from the display period to the vertical blank period and upon a change from the vertical blank period to the display period, a video data value difference can be eliminated, and a high-quality display free from noise lines displayed on the screen can be assured independently of data patterns to be displayed.

In particular, when a flat panel display constituted by two, upper and lower panels is used, a noise line is undesirably displayed on the middle portion of the screen if there is a video data value difference either upon a change from the display period to the vertical blank period or upon a change from the vertical blank period to the display period. However, when the flat panel display constituted by the two, upper and lower panels is controlled by the display control apparatus of the present invention, such a problem can be solved. Therefore, even when the flat panel display constituted by the two, upper and lower panels is used, a high-quality display can be realized.

According to the present invention, the display control apparatus comprises a display address generator for alternately generating display addresses of the upper and lower panels like a display address for the first line of the upper panel, a display address for the first line of the lower panel, a display address for the second line of the upper panel, a display address for the second line of the lower panel, . . . , a memory control circuit capable of alternately reading out display data from the video memory in response to the display addresses generated by the display address generator, and a line buffer having a capacity for displaying one line of the upper panel. At the same time as a write access of video data for one line of the upper panel is completed and display data for the next line of the lower panel is read out from the video memory, the video data for the upper panel stored in the line buffer is read out, the display data for the lower panel is converted to generate video data for the lower panel, and the video data for the upper and lower panel are output to the dual screen panel by synchronizing their output timings. A shift clock to be output to the dual screen panel LCD is not output in the first half of one horizontal scanning period since video data is written in the line buffer, and is output in synchronism with the video data for the upper and lower panels in the second half of the horizontal scanning period.

According to the present invention, since no frame buffer is allocated on an external video memory, no memory access is generated, and the same performance (rewrite speed of the video memory) as that of a CRT display can be maintained. Since the display timing is defined in synchronism with the original LCD timing, high display quality of the dual screen panel can be attained. Since only a line buffer is added, the CRT control circuit can be realized by a simple circuit arrangement. In addition, the present invention can easily cope with high-resolution dual screen panels.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figures 1, 3:
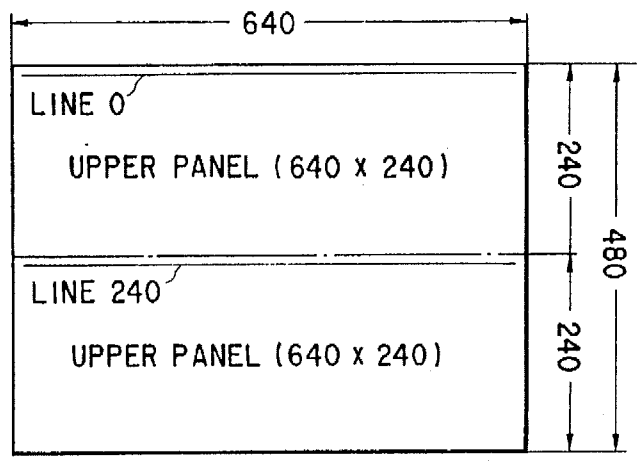
FIG. 1 (PRIOR ART)
FIG. 3 (PRIOR ART)
FIG. 1 is a table showing the relationship between the dummy data and noise lines obtained when a conventional display controller is used.
FIG. 3 is a view showing another example of noise line generation positions on the screen when the conventional display controller is used.
Figure 2:
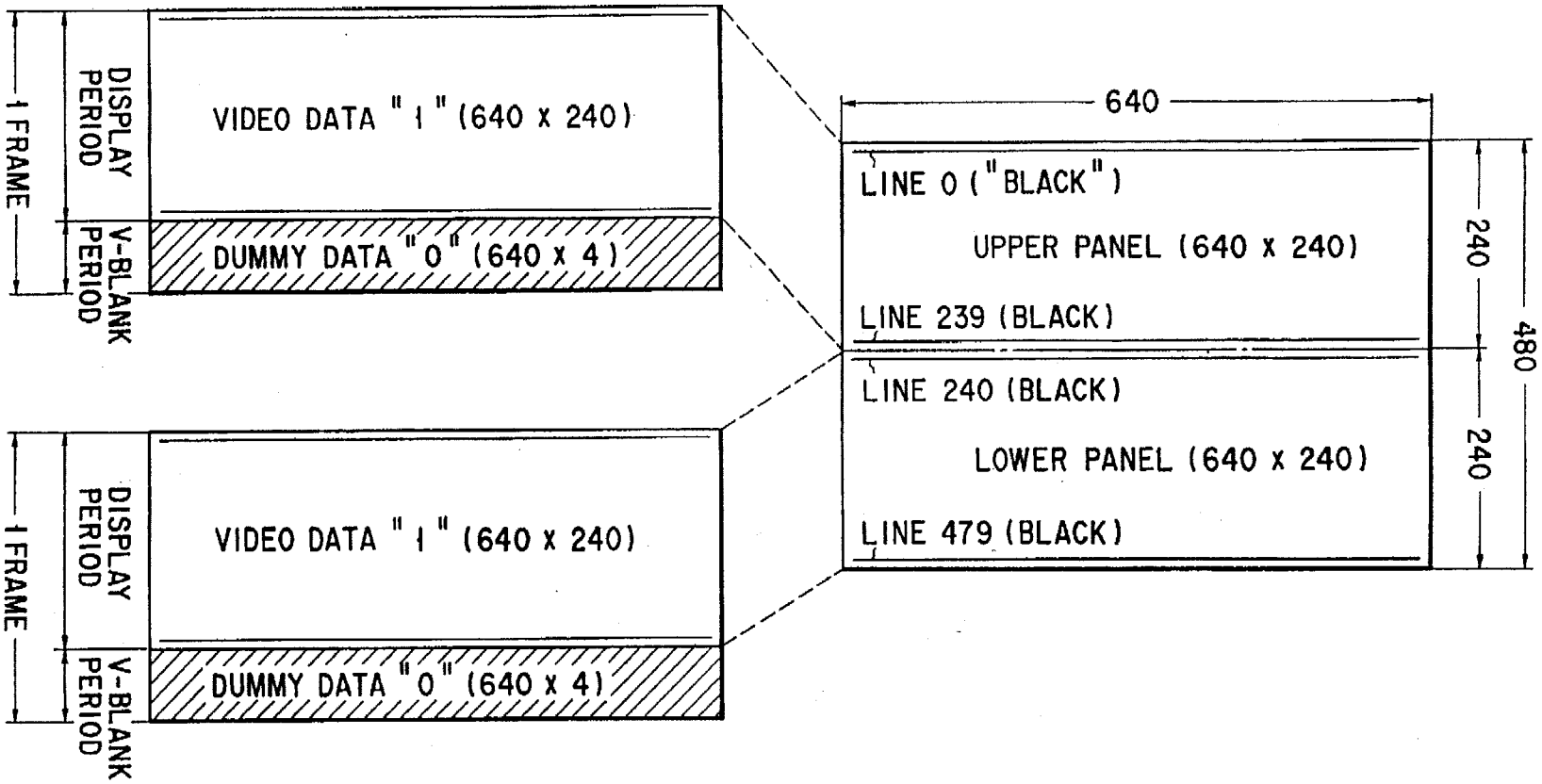
FIG. 2 (PRIOR ART)
FIG. 2 is a view showing an example of noise line generation positions on the screen when the conventional display controller is used.

The preferred embodiment of the present invention will be described below with reference to the accompanying drawings.

The principle of the control operation of a flat panel display executed by a display controller according to an embodiment of the present invention will be described below with reference to FIG. 4.

A display control system 4 is a display control system which supports VGA (Video Graphics Array) specifications having a display mode of simultaneously displaying a maximum of 256 colors at a resolution of 640×480 dots, and is connected to a system bus 2 of a personal portable computer. The display control system 4 performs display control for both a flat panel display 40 equipped as a standard device on the portable computer main body, and an analog CRT display 50 which is connected as an option to the portable computer main body.

The display control system 4 comprises a display controller 10 and an image memory (VRAM) 25. The display controller 10 and the VRAM 25 are mounted on a circuit board (not shown).

The flat panel display 40 is a simple matrix type STN monochrome or color LCD display, and supports a 640 (dots)×480 (lines) display screen. The flat panel display 40 is equipped with an upper panel unit 41*a* corresponding to an upper half display screen portion and a lower panel unit 41*b* corresponding to a lower half display screen portion. Each of the upper and lower panel units 41*a* and 41*b* has a 640 (dots)×240 (lines) dot matrix.

Figure 4:
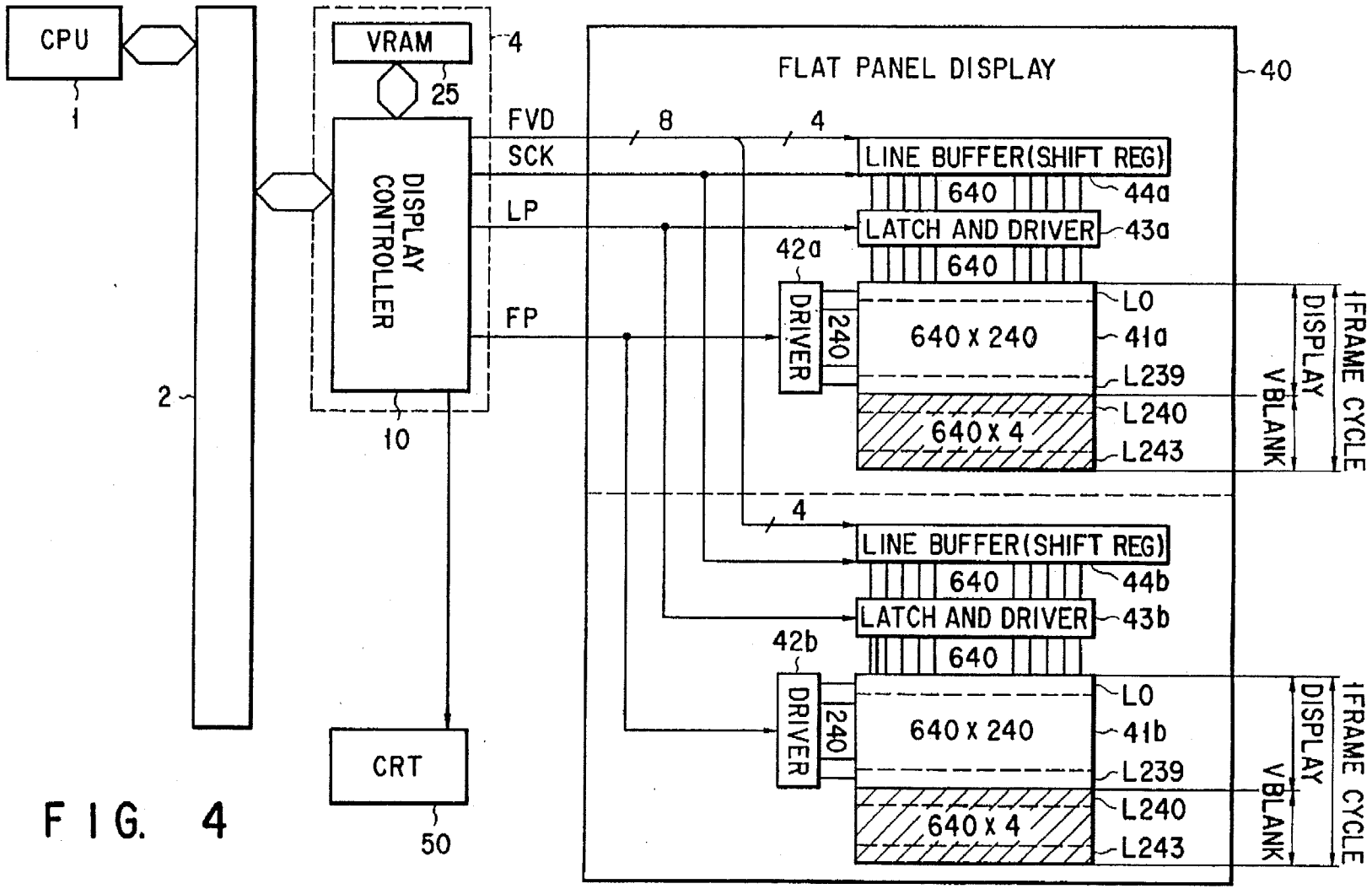
FIG. 4 is a block diagram for explaining the principle of the control operation of a flat panel display executed by a display controller according to an embodiment of the present invention.

In FIG. 4, the upper and lower panel units 41*a* and 41*b* are separately arranged. However, FIG. 4 illustrates these units separately for the sake of simplicity. In practice, the upper and lower panel units 41*a* and 41*b* are arranged adjacent to each other to constitute a single screen (640 dots×480 lines).

Pixels on the upper panel unit 41*a* are defined by overlapping positions between 640 segment electrodes arranged on one side of a liquid crystal layer and 240 common electrodes arranged on the other side of the liquid crystal layer. A horizontal array of pixels for 640 dots constitutes one display line. Similarly, on the lower panel unit 41*b*, pixels are defined by overlapping positions between 640 segment electrodes arranged on one side of the liquid crystal layer and 240 common electrodes arranged on the other side of the liquid crystal layer, and a horizontal array of pixels for 640 dots constitutes one display line.

The display controller 10 supplies flat panel video data FVD, a latch pulse LP, a field pulse FP, and a shift clock SCK to the flat panel display 40. The flat panel video data FVD includes 4-bit width video data for the upper panel and 4-bit width video data for the lower panel, and has an 8-bit width size.

The latch pulse LP and the field pulse FP are respectively utilized as horizontal and vertical sync signals of the flat panel display 40. The shift clock SCK is a clock used for sequentially transferring the flat panel video data FVD to a line buffer of the flat panel display 40, and is supplied to the flat panel display 40 in synchronism with the flat panel video data FVD.

The display controller 10 controls the flat panel display 40 in a frame cycle having a vertical display period for 240 lines (L0 through L239), and a vertical blank period (VBLANK) for four lines (L240 through L243). The four lines (L240 through L243) in the vertical blank period are blank lines, and during this vertical blank period, none of display lines on the upper and lower panel units 41*a* and 41*b* are selected.

The frame cycle including such a vertical blank period can be defined by the relationship between the generation timings of the latch pulse LP and the field pulse FP.

The operation of the flat panel display 40 based on the latch pulse LP, the field pulse FP, and the shift clock SCK will be briefly described below.

First, the upper panel unit 41*a* will be described.

The upper panel unit 41*a* is controlled by a common driver 42*a*, a latch and segment driver 43*a*, and a line buffer 44*a*.

The common driver 42*a* sequentially supplies a drive signal to the 240 common electrodes of the upper panel unit 41*a*, thereby sequentially selecting 240 display lines (L0 through L239) in units of lines. The selection operation of the display lines is started in response to the field pulse FP input from the display controller 10, and the 240 display lines from a display start line (line L0) through a display final line (line L239) are sequentially selected. When the next field pulse FP is input, the selection operation is started from the display start line (line L0) again.

The latch and segment driver 43*a* latches video data for 640 dots, which data is transferred to the line buffer 44*a*, and parallelly supplies a data signal corresponding to the latched data to the 640 segment electrodes. The latch operation of video data from the line buffer 44*a* is executed each time a latch pulse LP is supplied from the display controller 10.

The line buffer 44*a* is used for holding the video data FVD for one line, i.e., 640 dots, and comprises shift registers. The video data FVD is input to the line buffer 44*a* together with the shift clock SCK, and is sequentially shifted from the left end toward the right end of the line buffer 44*a* in synchronism with the input timing of the shift clock SCK.

The lower panel unit 41*b* is controlled by a common driver 42*b*, a latch and segment driver 43*b*, and a line buffer 44*b*. These common driver 42*b*, latch and segment driver 43*b*, and line buffer 44*b* are the same as the common driver 42*a*, latch and segment driver 43*a*, and line buffer 44*a* of the above-mentioned upper panel unit 41*a*.

The first control method of the flat panel display during the vertical blank period (VBLANK) as the characteristic feature of the present invention will be described below with reference to the timings charts in FIGS. 5A through 5E.

Figures 5A, 5B, 5C, 5D, 5E:
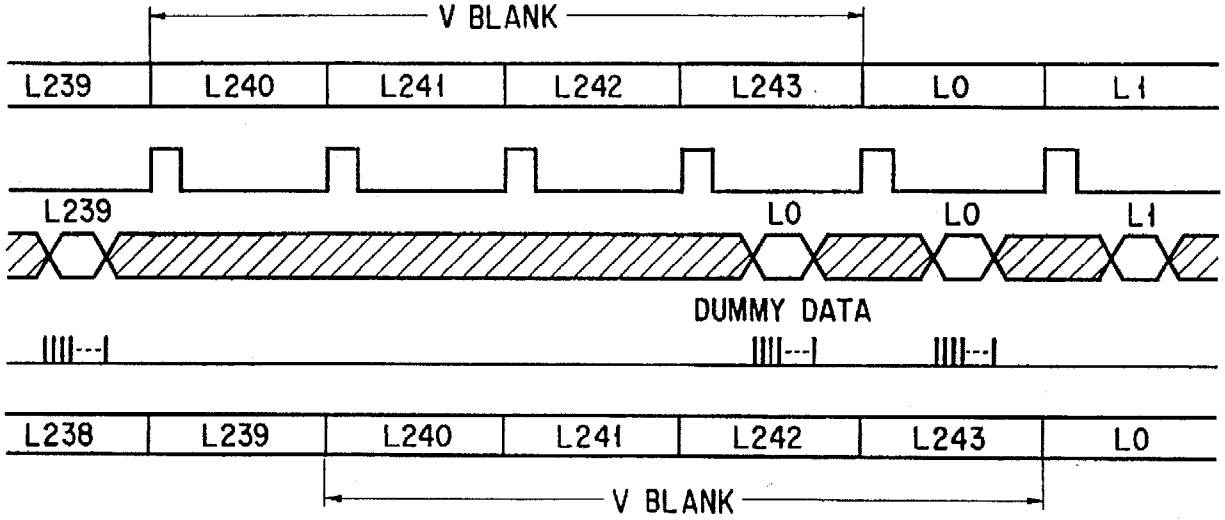
FIGS. 5A through 5E are timing charts for explaining the first control method of the flat display panel executed by the display controller of the embodiment shown in FIG. 4.

As described above, since the operations of the upper and lower panel units 41*a* and 41*b* are similarly controlled except for input video data, only the control for the upper panel unit 41*a* during the vertical blank period (VBLANK) will be explained below. FIG. 5A shows display timing of the controller and FIG. 5E shows display timing within the panel.

More specifically, during the vertical display period, the display controller 10 outputs video data FVD (FIG. 5C) for 640 dots to be displayed on a target display line together with a shift clock SCK (FIG. 5D). In the upper panel unit 41*a*, the video data FVD is sequentially fetched in the line buffer 44*a* in synchronism with the shift clock SCK.

Upon completion of transfer of the video data FVD for one display line, the display controller 10 generates a latch pulse LP (FIG. 5B). In the upper panel unit 41*a*, the video data FVD for 640 dots in the line buffer 44*a* is latched by the latch and segment driver 42*a* in response to the latch pulse LP, and a data signal corresponding to the video data FVD is parallelly supplied to the 640 segment electrodes. At this time, the common electrode of the target display line has been selected by the common driver 42*a*, and a display on the target display line is started.

During the display period of data on the target display line, the display controller 10 outputs video data FVD for 640 dots to be displayed on the next target display line together with a shift clock SCK. Thus, during the display operation of the target display line, the video data FVD of the next display line is sequentially fetched by the line buffer 44*a*.

In this manner, during the vertical display period, the display controller 10 sequentially transfers flat panel video data FVD for 240 lines from the display start line (line L0) to the display final line (line 239) to the line buffer 44*a* in units of lines.

During the vertical blank period (VBLANK), in order to prevent generation of the above-mentioned noise lines, the display controller 10 outputs the same video data FVD as that on the display final line (L239) as dummy data of the vertical blank period start line (L240), and also outputs video data to be displayed on the display start line (L0) in the next frame cycle as dummy data of the vertical blank period final line (L243) in advance. The display controller 10 outputs shift clocks SCK together with these dummy data.

As a result, the contents of the line buffer 44*a* on the display final line (L239) are set to be the same as those on the start line (L240) of the vertical blank period immediately after the display final line, and the contents of the line buffer 44*a* on the display start line (L0) in the next frame cycle are set to be the same as those on the final line (L243) of the vertical blank period immediately before the display start line.

For this reason, both upon a change from the display period to the vertical blank period and upon a change from the vertical blank period to the display period, any video data value difference can be eliminated, and a problem associated with noise lines displayed on the screen can be prevented independently of data patterns to be displayed.

Note that dummy data on the second and third lines (L241 and L242) of the vertical blank period may have any data pattern, or may not be generated.

Figures 6A, 6B, 6C, 6D, 6E:
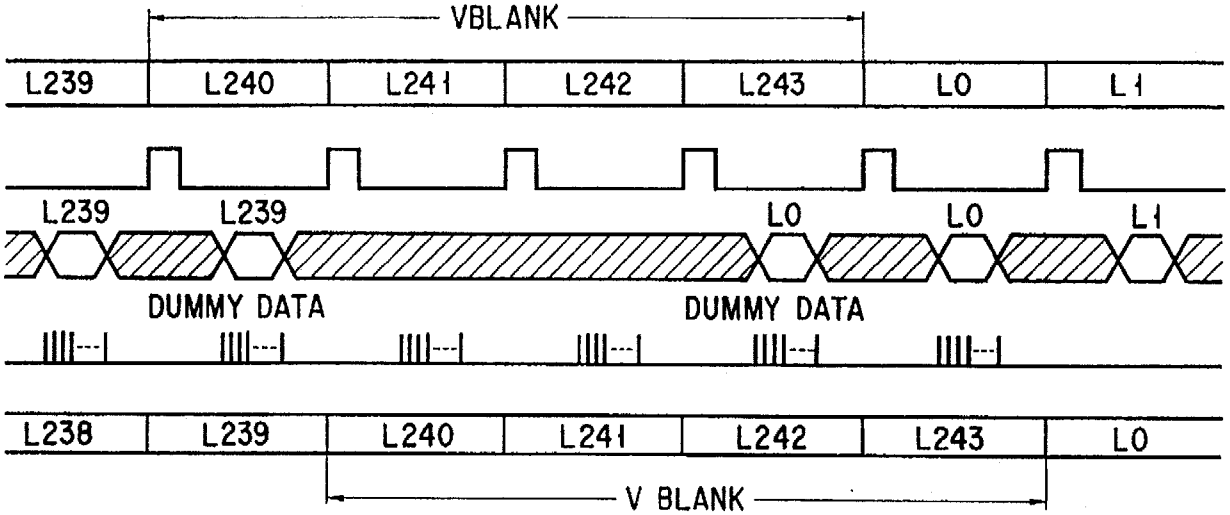
FIGS. 6A through 6E are timing charts for explaining the second control method of the flat display panel executed by the display controller of the embodiment shown in FIG. 4.

The second control method of the flat panel display during the vertical blank period (VBLANK) will be described below with reference to the timing charts shown in FIGS. 6A through 6E. FIG. 6A shows display timing of the controller and FIG. 6E shows display timing within the panel. FIGS. 6B, 6C and 6D respectively show timing of latch pulse LP, video output FVD and shift clock SCK.

Upon a change from the vertical display period to the vertical blank period (VBLANK), the display controller 10 stops supply of shift clocks SCK (FIG. 6D) to the flat panel display 40. The supply of shift clocks SCK is stopped for three lines from the vertical blank period start line, i.e., from the 240th line L240 to the 242nd line L242, and is restarted from the vertical blank period final line (L243).

When supply of shift clocks SCK is stopped, the contents of the line buffer 44*a* are not updated, and video data immediately before stop of shift clocks SCK, i.e., video data on the display final line (L239) is kept held. Therefore, the contents of the line buffer 44*a* on the display final line (L239) are set to be the same as those on the start line (L240) of the vertical blank period immediately after the display final line.

For the vertical blank period final line (L243), video data to be displayed on the display start line (L0) in the next frame cycle is output in advance as dummy data in the same manner as in the above-mentioned first method. Therefore, the contents of the line buffer 44*a* on the display start line (L0) in the next frame cycle are set to be the same as those on the final line (L243) of the vertical blank period immediately before the display start line.

Therefore, with the second method as well, both upon a change from the vertical display period to the vertical blank period and upon a change from the vertical blank period to the display period, any video data value difference can be eliminated, and a problem associated with noise lines displayed on the screen can be prevented.

The arrangement of the display controller 10 for controlling the flat panel display 40 by the above-mentioned first or second method will be described below.

First, the overall arrangement of the display control system 4 including the display controller 10 and the VRAM 25 will be described below with reference to FIG. 7.

The display controller 10 is a single LSI realized by a gate array, and constitutes principal part of this display control system 4. The display controller 10 is connected to a CPU 1 of the portable computer via the system bus 2, and draws data on the VRAM 25 in accordance with a request from the CPU 1. The display controller 10 converts data drawn on the VRAM 25 into video data, and outputs the converted data to the flat panel display 40 or the CRT display 50 to refresh their screens.

The VRAM 25 stores display data to be displayed on the flat panel display 40 or the CRT display 50. The VRAM 25 is a dual-port memory, and has a dynamic RAM and an SAM (serial access memory). Random access to the RAM is executed via a random access port (DATA), and serial access to the SAM is executed via a serial access port (S-DATA). In this case, the serial access port (S-DATA) is used for reading out data to refresh the screen, and the parallel access port (DATA) is used for updating data. For this reason, the VRAM 25 can execute the data read operation for refreshing the screen simultaneously with the updating operation of its storage contents.

Display data is stored in the VRAM 25 in a predetermined data format. As the data format, a 4-bit/pixel format, an 8-bit/pixel format, and the like are available. Since the serial port (S-DATA) of the VRAM 25 has a 32-bit width, 4-bit/pixel memory data for eight dots or 8-bit/pixel memory data for four dots can be simultaneously read out.

Figure 7:
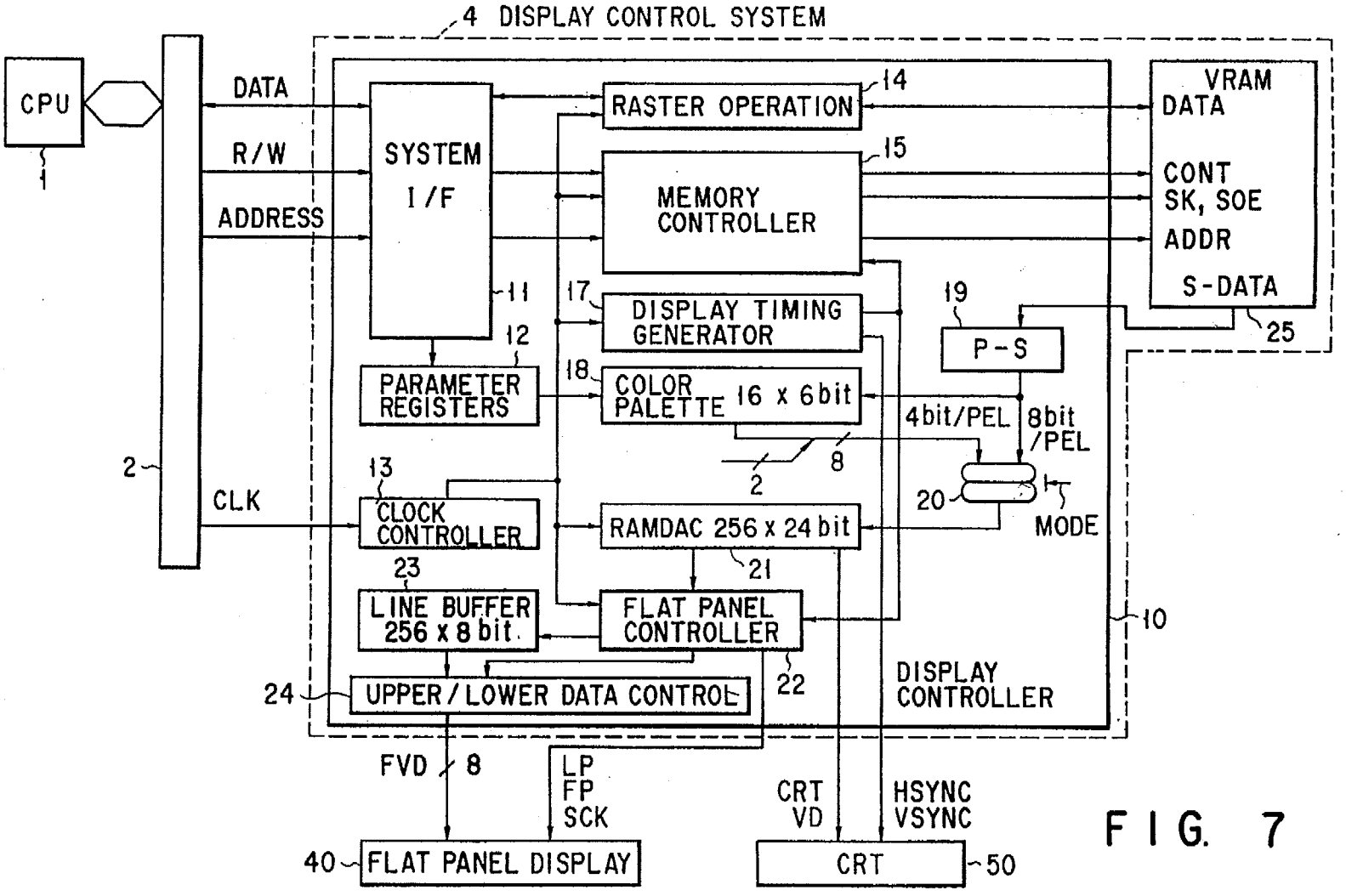
FIG. 7 is a block diagram showing the arrangement of a display control system including the display controller of the embodiment shown in FIG. 4.

As shown in FIG. 7, the display controller 10 comprises a system interface (I/F) 11, parameter registers 12, a clock controller 13, a raster operation circuit 14, a memory controller 15, a display timing generator 17, a color palette 18, a parallel-to-serial (P-S) converter 19, a multiplexer 20, a RAMDAC 21, a flat panel controller 22, a line buffer 23, and an upper/lower data control circuit 24.

The system I/F 11 is used for exchanging, e.g., system data with the CPU 1 via the system bus 2, and is provided with the parameter registers 12. The parameter registers 12 are set with various parameters for defining a display mode (a text mode, a graphics mode) of the flat panel display 40 and the CRT display 50, and color data to be written in the color palette 18. These parameters and color data are given by the system data from the CPU 1.

The clock controller 13 generates a video clock, and the like on the basis of a bus clock of 14.318 MHz from the system bus 2. The video clock VDCLK is a synchronization clock for outputting video data to the flat panel display 40 or the CRT display 50 in synchronism with the display timing of the display in units of dots, and has a frequency of, e.g., about 28.322 MHz. The value of the frequency of the video clock VDCLK is determined on the basis of the horizontal/vertical scanning frequency of the flat panel display 40 or the CRT display 50.

The raster operation circuit 14 has a function of transferring the system data from the CPU 1 to the memory controller 15 as write data, and a drawing function of executing various raster operations for display data read out from the VRAM 25 by the memory controller 15. In the drawing mode, display data read out from the VRAM 25 is subjected to logic operations by the raster operation circuit 14, and the operation result is written in the VRAM 25 again. The contents of the operations are controlled by parameters set in the parameter registers 12.

The memory controller 15 executes access control of the VRAM 25. More specifically, the memory controller 15 executes random access control of the VRAM 25 in accordance with a memory read/write request from the CPU 1, and executes serial access control of the VRAM 25 in accordance with a display timing signal from the display timing generator 17.

When data is to be displayed on the flat panel display 40 constituted by the two, upper and lower panels, the memory controller 15 executes the serial access control of the VRAM 25 to alternately read out upper and lower panel display data from the VRAM 25 in units of dots or lines.

In this case, the serial control of the VRAM 25 is executed by data transfer from the RAM to the SAM and serial read of the SAM. In the data transfer from the RAM to the SAM, one line to be transferred on the RAM is designated by a memory address ADDR from the memory controller 15, and data for the line is transferred from the RAM to the SAM. In the serial read of the SAM, the SAM start address is designated by the memory address ADDR from the memory controller 15, and the SAM address is sequentially counted up in synchronism with serial clocks SK. Thus, data are sequentially read out from the SAM in synchronism with the serial clocks SK.

The display timing generator 17 generates a display timing signal for the flat panel display 40, and supplies it to the memory controller 15 and the flat panel controller 22. The display timing generator 17 also generates a horizontal sync signal HSYNC and a vertical sync signal VSYNC for the CRT display 50.

The color palette 18 is used for determining the color attributes of 4-bit/pixel data output from the P-S converter 19, and comprises 16 color palette registers. The color palette 18 receives 4-bit/pixel data from the P-S converter 19 as an index, and one of the 16 color palette registers is selected. Each color palette register is set with 6-bit color palette data. The 6-bit color palette data read out from the selected color palette register is added to 2-bit color selection data 39 output from a color selection register in the parameter registers 12 to obtain data of a total of 8 bits. The 8-bit data is supplied to the multiplexer 20 as CRT video data.

The P-S converter 19 converts 32-bit memory data (eight pixel data in the 4-bit/pixel format; four pixel data in the 8-bit/pixel format) simultaneously read out from the serial access port (S-DATA) of the VRAM 25 into data in units of pixels, and serially outputs the converted data. The 4-bit/pixel memory data is supplied to the multiplexer 20 via the color palette 18, and the 8-bit/pixel memory data is directly supplied to the multiplexer 20 as CRT video data.

The multiplexer 20 selects the CRT video data from one of the color palette 18 and the P-S converter 19, and supplies the selected data to the RAMDAC 21.

The RAMDAC 21 is used for generating R, G, and B analog color CRT video data (CRTVD) for the color CRT display 50, and comprises a color table which uses 8-bit CRT video data as an index, and a D/A converter for converting color data read out from the color table into an analog signal. In the VGA specifications, a display mode capable of simultaneously displaying 256 colors is available. In order to support this display mode, the color table includes 256 color registers, and one of these registers is selected by CRT video data input to the RAMDAC 21. Each color register stores color data of a total of 18 bits, including R, G, and B data of 6 bits each. The color data stored in the selected color register is supplied to the flat panel controller 22 as digital R, G, and B data, and is also supplied to the internal D/A converter of the RAMDAC 21. The D/A converter converts the digital R, G, and B data into analog R, G, and B signals, and supplies them to the CRT display 50.

The flat panel controller 22 generates the latch pulse LP, the field pulse FP, and the shift clock SCK in accordance with the display timing signal from the display timing generator 17, and supplies them to the flat panel display 40. The flat panel controller 22 emulates the 18-bit digital R, G, and B data from the RAMDAC 21 to be 4-bit monochrome gray-scale video data for the flat panel display 40. The 4-bit monochrome gray-scale video data for the upper panel is supplied to the line buffer 23, and is stored therein for one line. On the other hand, the 4-bit monochrome gray-scale video data for the lower panel is supplied to the upper/lower data control circuit 24 comprising a multiplexer, and is added to the 4-bit monochrome gray-scale video data for the upper panel stored in the line buffer 23. The sum data is supplied to the flat panel display 40 as flat panel monochrome gray-scale video data FVD of a total of 8 bits.

Figure 8:
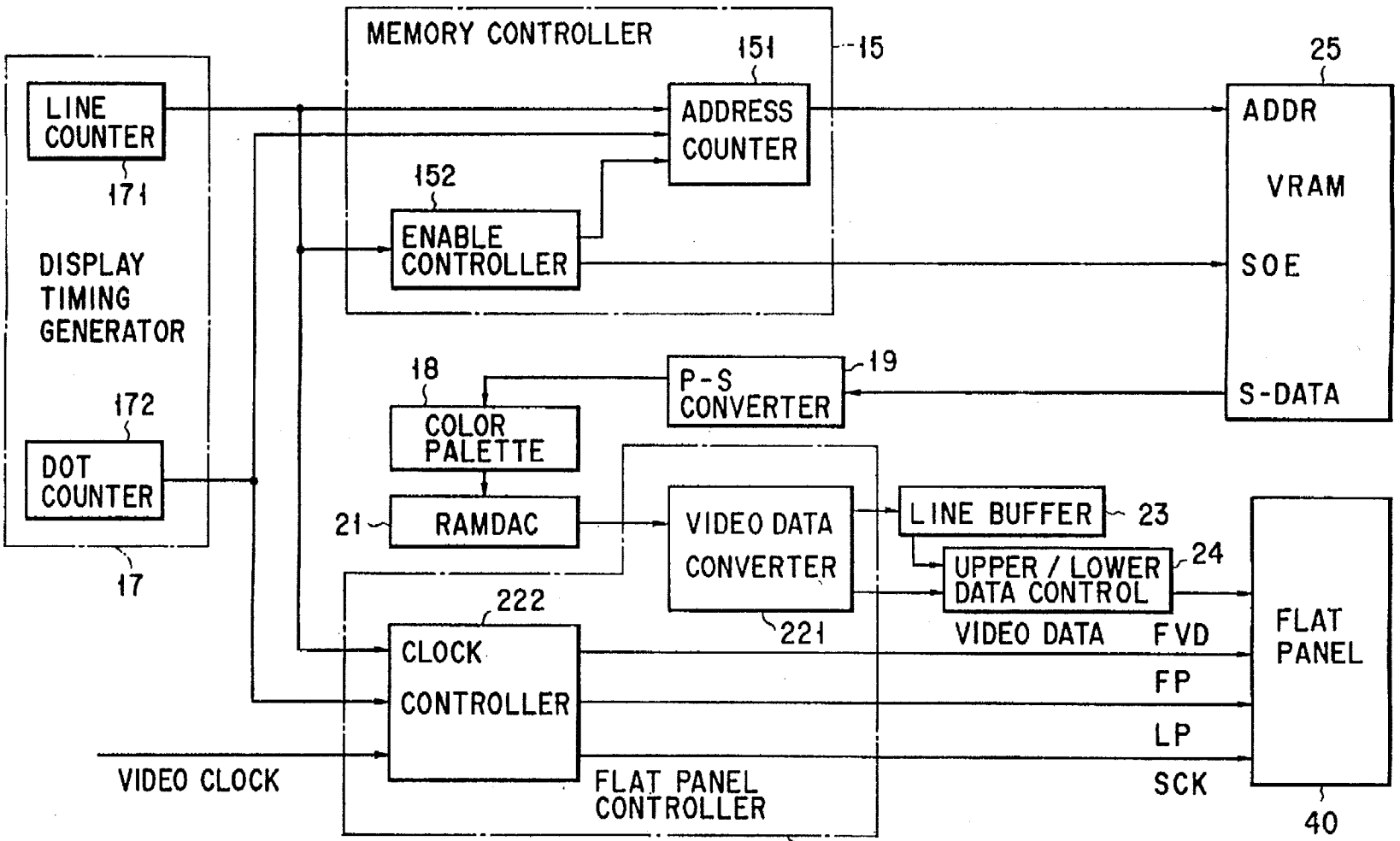
FIG. 8 is a block diagram showing units associated with control of the flat panel display of those included in a display controller 10 shown in FIG. 7.

FIG. 8 shows the detailed arrangement of units associated with control of the flat panel display 40 of those included in the display controller 10.

As shown in FIG. 8, the display timing generator 17 includes a line counter 171 and a dot counter 172.

The line counter 171 is used for counting the number of lines in the vertical direction, and its count value designates vertical lines to be displayed on the upper and lower panels of the flat panel display 40. Since the total number of vertical lines of each panel of the flat panel display 40 is 244 (240 vertical display lines L0 through L239+4 vertical blank lines L240 through L243), the count value of the line counter 171 is sequentially counted up from 0 to 243, and is restarted from 0 after 243. The dot counter 172 counts the number of dots in the horizontal direction. Since the number of dots in the horizontal direction of each panel of the flat panel display 40 is 640, the count value of the dot counter 172 is sequentially counted up from 0 to 639, and is restarted from 0 after 639. The count value of the dot counter 172 is supplied, together with the count value of the line counter 171, to the memory controller 15 and the flat panel controller 22 as the above-mentioned display timing signal of the display timing generator 17.

The memory controller 15 comprises an address counter 151 and an enable controller 152, as shown in FIG. 8.

The address counter 151 generates a display address on the basis of the count values of the line counter 171 and the dot counter 172. The display address value indicates the start address of a target display line on the VRAM 25, which stores display data for one frame, and is supplied to the VRAM 25 as a RAM-SAM transfer memory address. The enable controller 152 generates an enable signal for the address counter 151 and a serial output enable signal (SOE) for the VRAM 25.

Figure 14:
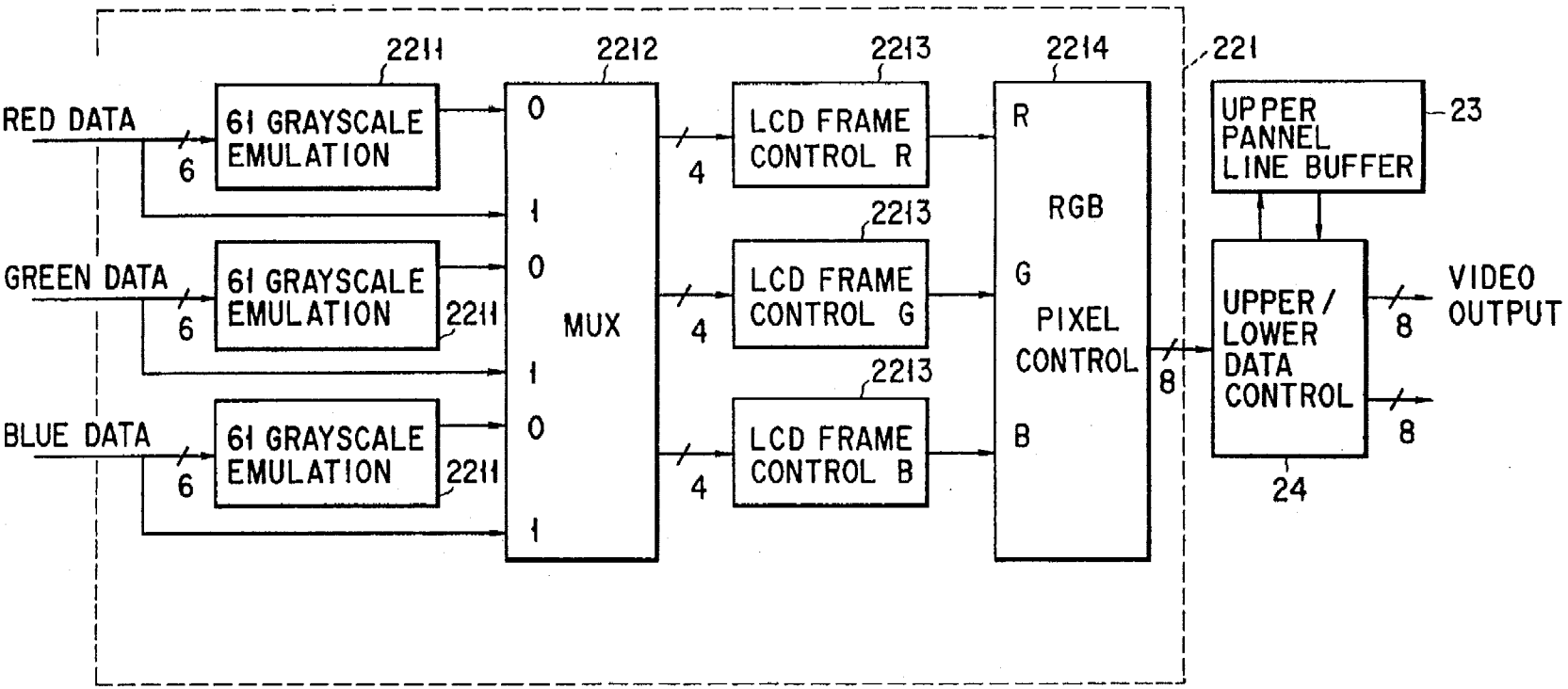
FIG. 14 is a detailed block diagram showing the arrangement for a color LCD of a video data converter shown in FIG. 8.

The flat panel controller 22 comprises a video data converter 221 and a clock controller 222. The video data converter 221 emulates the digital R, G, and B data from the RAMDAC 21 to be color video data or monochrome gray-scale video data for the flat panel display 40. More specifically, since the STN color LCD allows 16 gray-scale levels for each of R, G, and B colors, 4,096 ($16^3$) colors can be displayed. Therefore, as shown in FIG. 14, the R, G, and B 6-bit data output from the RAMDAC 21 are respectively supplied to 61-gray-scale emulation circuits 2211, and are also supplied to a multiplexer 2212. The multiplexer 2212 outputs 4-bit (16 gray-scale levels) data from each of the 61-gray-scale emulation circuits 2211 or upper 4-bit (16 gray-scale levels) data of each of R, G, and B 6-bit data from the RAMDAC 21 to a corresponding one of LCD frame control circuits 2213. In the STN type LCD, one pixel is expressed by a single gray-scale level. For this reason, in order to express 16 gray-scale levels by a single gray-scale level, pixels are turned on/off to have a frame period. In this case, in order to avoid flickering caused by simultaneous blinking of neighboring pixels, a dither pattern suited for a gray-scale level to be expressed is used. This control is performed by the frame control circuits 2213. The R, G, and B 4-bit data output from the LCD frame control circuits 2213 are arranged in a predetermined order by an RGB pixel control circuit 2214, are set to have a video data width determined by the period of the shift clock (SCK) input to the flat panel display 40, and are output as 8-bit data to the upper/lower data control circuit 24.

In the case of the monochrome LCD, the R, G, and B 6-bit data output from the RAMDAC 21 are converted into gray-scale data having an optimal brightness by a brightness calculation circuit 2215, and the converted data is converted into 4-bit gray-scale data by the 61-gray-scale emulation circuit 2211 or a conversion table 2216. The converted data is input to the frame control circuit 2213 to achieve the same frame control as described above, and is then output to the upper/lower data control circuit 24. Note that LCD frame processing (frame-rate control) and dither processing are described in U.S. Ser. No. 740,168 "Color Display Control Apparatus for Controlling Display Gray Scale of each Scanning Frame or each of plurality of dots", filed on Aug. 15, 1991, Hiroshi UCHIKOGA et al, filed by the same assignee as the present application.

The video data converter 221 comprises an interface with the line buffer 23.

The clock controller 222 generates the above-mentioned latch pulse LP, field pulse FP, and shift clock CK. Generation of these signals is controlled on the basis of the count values of the line counter 171 and the dot counter 172. The shift clock SCK is output in synchronism with a video clock.

Figure 15:
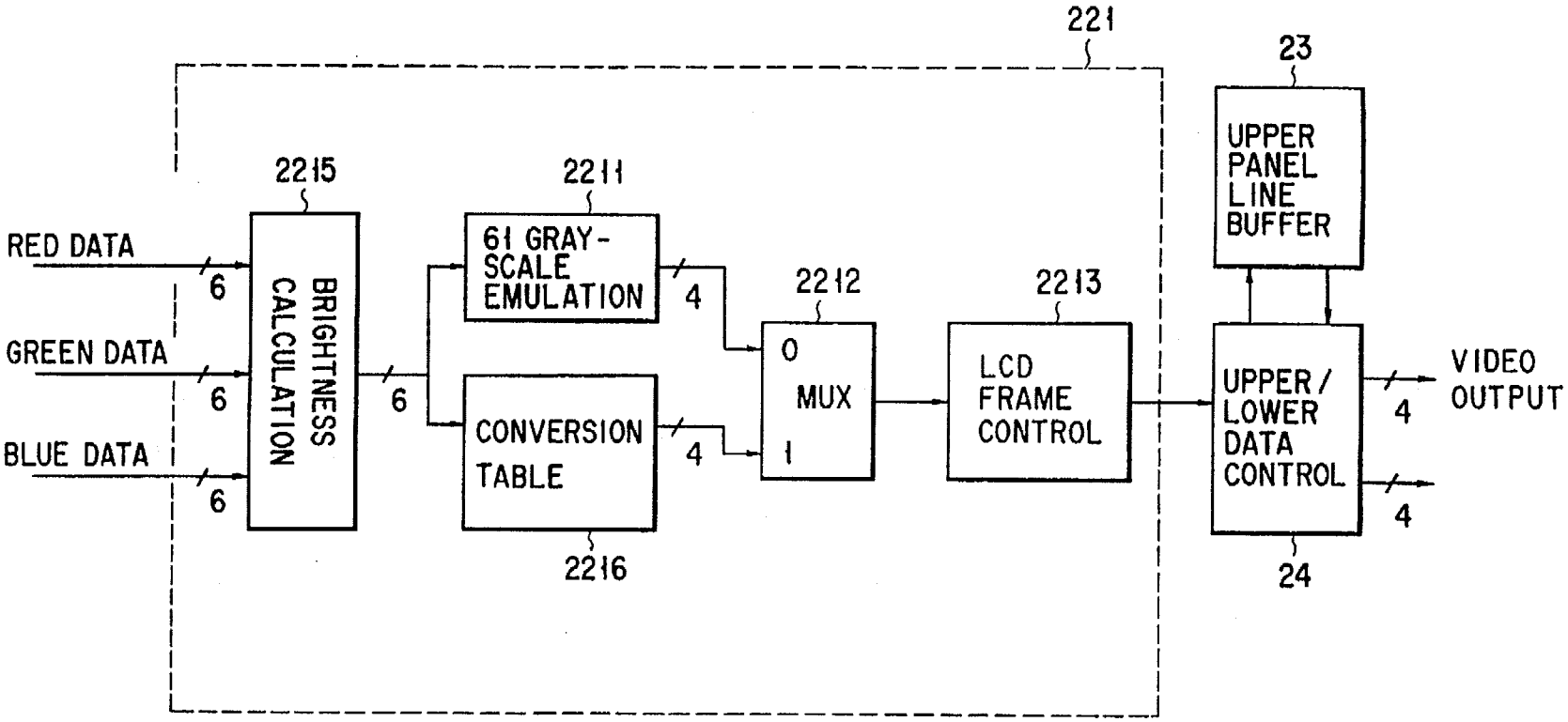
FIG. 15 is a detailed block diagram showing the arrangement for a monochrome LCD of the video data converter shown in FIG. 8.
Figure 16:
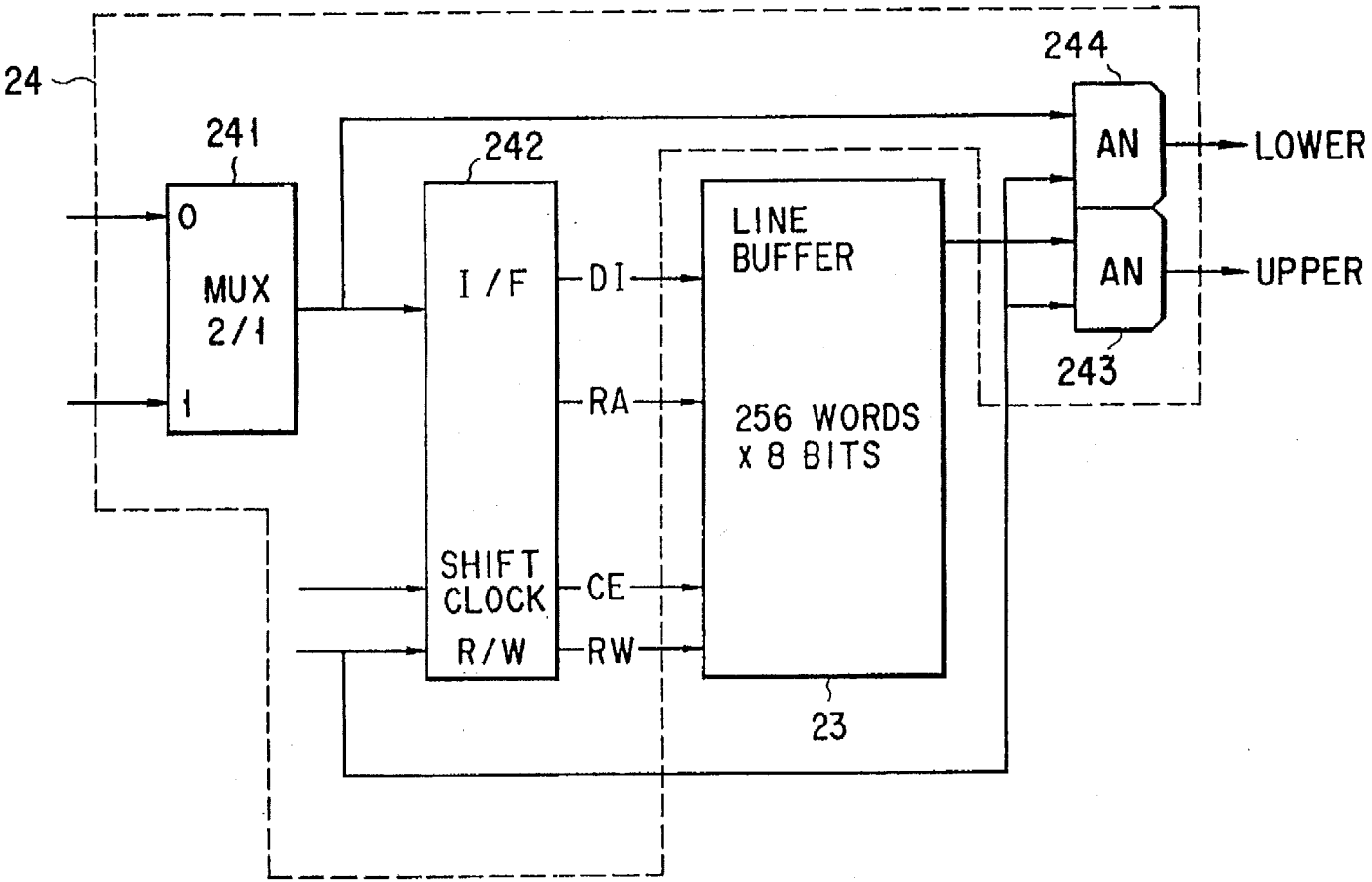
FIG. 16 is a detailed block diagram of an upper/lower data control circuit shown in FIG. 8.

The line buffer 23 comprises a 256 (words)×8 (bits) RAM, and stores color video data or monochrome gray-scale video data for one line of the upper panel output from the video data converter 221. The upper/lower data control circuit 24 outputs display data for one line of the upper panel stored in the line buffer 23 together with display data for one line of the lower panel. More specifically, since one horizontal scanning period of the dual panel screen has a duration twice that of the CRT, LCD video data for one line of the upper panel is stored in the line buffer 23 in the first half of one horizontal scanning period (LCD screen). In the second half of the horizontal scanning period, data for one line of the lower panel is read out, and at the same time, the data for one line of the upper panel stored in the line buffer 23 is read out. These readout data are output together from the upper/lower data control circuit 24 to the flat panel display 40. FIG. 16 is a detailed block diagram of the upper/lower data control circuit 24. Upon display of data on the upper and lower panels, one of STN color LCD data from the RGB pixel control circuit 2214 shown in FIG. 14 and STN monochrome LCD data from the frame control circuit 2213 shown in FIG. 15 is selected by a multiplexer 241, and the selected data is supplied to a lower panel AND gate 244. At the same time, the shift clock (SCK) and a read signal are supplied to the line buffer 23 via an interface circuit 242 to read out line data of the upper panel. The readout data is supplied to an upper panel AND gate 243. As a result, the AND gates 244 and 243 output upper and lower panel data in response to the read signal. When upper panel data is stored, display data from the multiplexer 241 is supplied to the line buffer 23 via the interface circuit 242, and the data for one line of the upper panel is written in the line buffer 23 in response to a write signal.

Figures 13A, 13B, 13C, 13D, 13E, 13F, 13G, 13H, 13I, 13J:
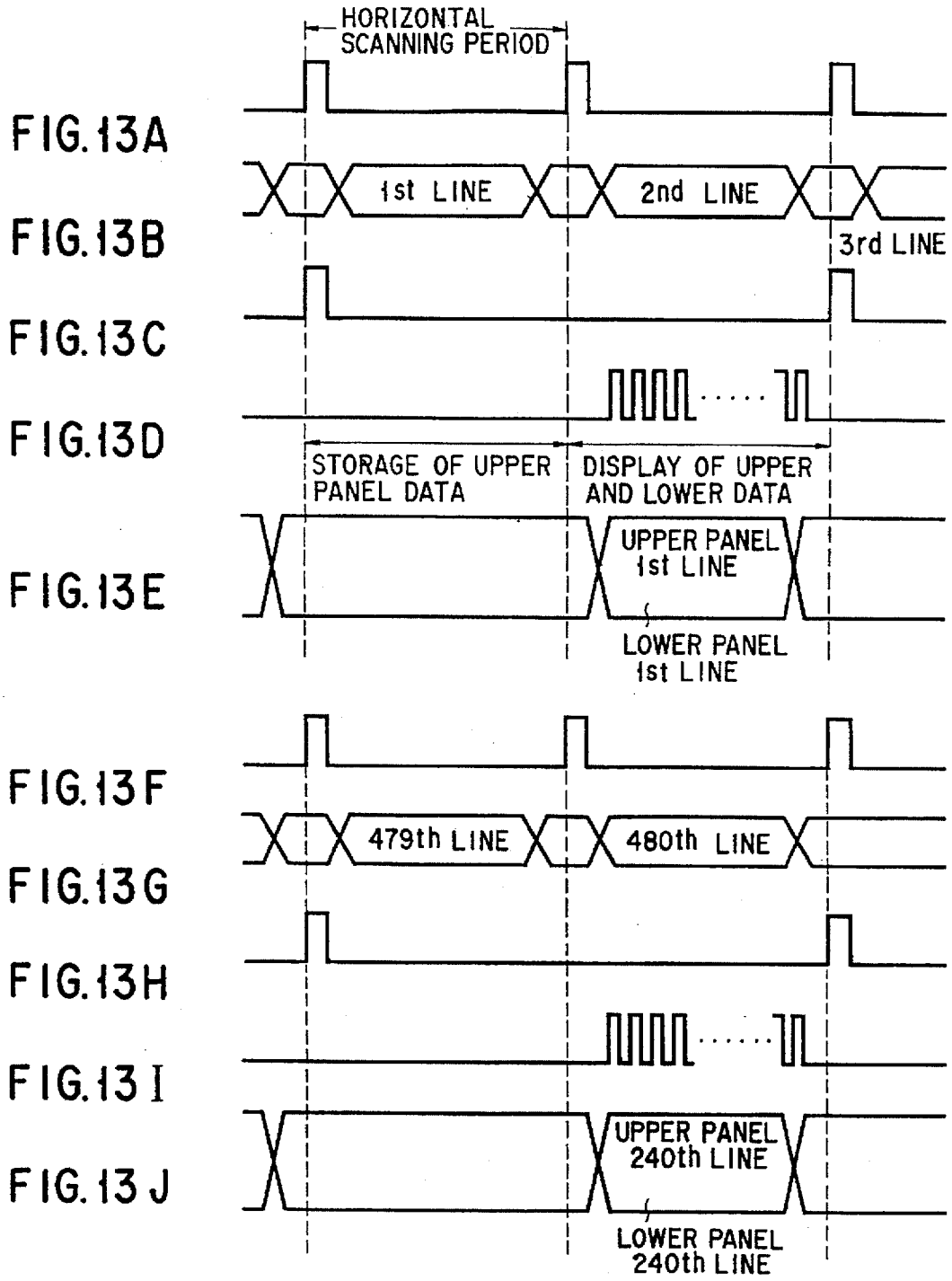
FIGS. 13A through 13J are timing charts showing the display timing in dual screen panel control.
Figures 17A, 17B, 17C, 17D, 17E:
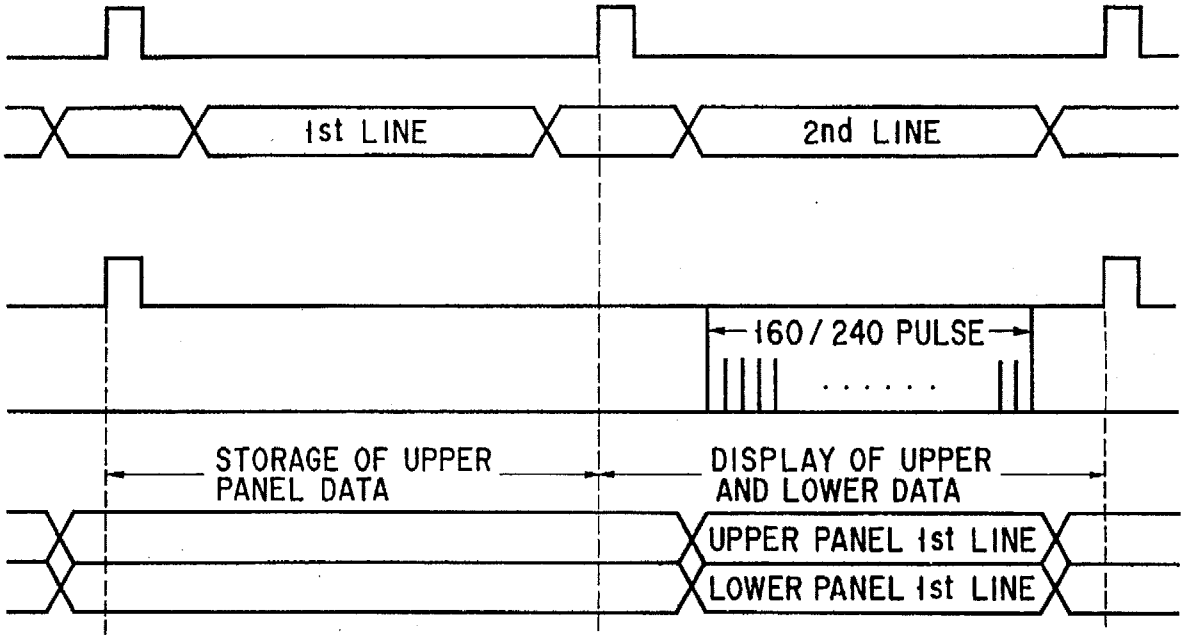
FIGS. 17A through 17E are timing charts showing the timing of a shift clock to be supplied to a color LCD.

FIGS. 13A through 13J show the display timings in dual panel screen (480 lines) control. In particular, FIGS. 13A through 13J show horizontal sync signal (CRT) (FIGS. 13A and 13F), CRT output (FIGS. 13B and 13G), latch pulse LP (FIGS. 13C and 13H), shift clock SCK (FIGS. 13D and 13I) and VD (FIGS. 13E and 13J). FIG. 13A shows the CRT horizontal sync signal, and in particular one horizontal scanning period of the CRT. Since one horizontal scanning period of the dual panel screen has a duration twice that of the CRT, LCD video data is stored in the line buffer 23 in the first half of the horizontal scanning period, and upper and lower panel data are output in the second half. More specifically, as shown by the CRT output in FIG. 13B, during the output period of the first line of the CRT, data of the first line of the upper panel is stored in the line buffer 23. During the output period of the second line of the CRT, data of the first line of the lower panel is read out from the VRAM 25, the data of the first line of the upper panel stored in the line buffer 23 is read out, and data of the first lines of the upper and lower panels are simultaneously displayed. The same operation as described above is repeated, and as shown in FIGS. 13G and 13J, which respectively show timing of CRT output and VD, during the output period of the 479th line of the CRT, data of the 240th line of the upper panel is stored in the line buffer 23. During the output period of the 480th line of the CRT, data of the 240th line of the lower panel is read out from the VRAM 25, the data of the 240th line of the upper panel stored in the line buffer 23 is read out, and the data of the 240th lines of the upper and lower panels are simultaneously displayed. A required number of shift clocks (SCK FIG. 13I) which catch video data on the side of the LCD panels are output in synchronism with the timing of video data in the second half of one horizontal scanning period of the panels. For example, in the case of 480-line display, as shown in FIG. 17E, 240 pulses are output for the STN color LCD, and 160 pulses are output for the STN monochrome LCD. FIGS. 17A through 17D respectively show timing charts for latch pulse (1/480), video output (1/480), latch pulse (1/240) and shift clock (1/240).

The operation of the display controller 10 shown in FIG. 8 which controls the flat panel display 40 by the above-mentioned first method will be described below with reference to the timing charts in FIGS. 9A through 9F, which respectively show timing for the line counter, address counter, serial output enable SOE, latch pulse LP, video output FVD and shift clock SCK.

After the address counter 151 outputs the start address of the display final line (L239), the line counter 171 (FIG. 9A) indicates the start line (L240) of the vertical blank period. At this time, the address counter 151 (FIG. 9B) does not execute a count operation due to the vertical blank period, and keeps holding the start address of the display final line (L239). In this case, display data of the display final line (L239) is transferred again from the RAM to the SAM in the VRAM 25. The enable controller 152 maintains the serial output enable signal SOE (FIG. 9C) at active "H" level up to the start line (L240) of the vertical blank period.

Figures 9A, 9B, 9C, 9D, 9E, 9F:
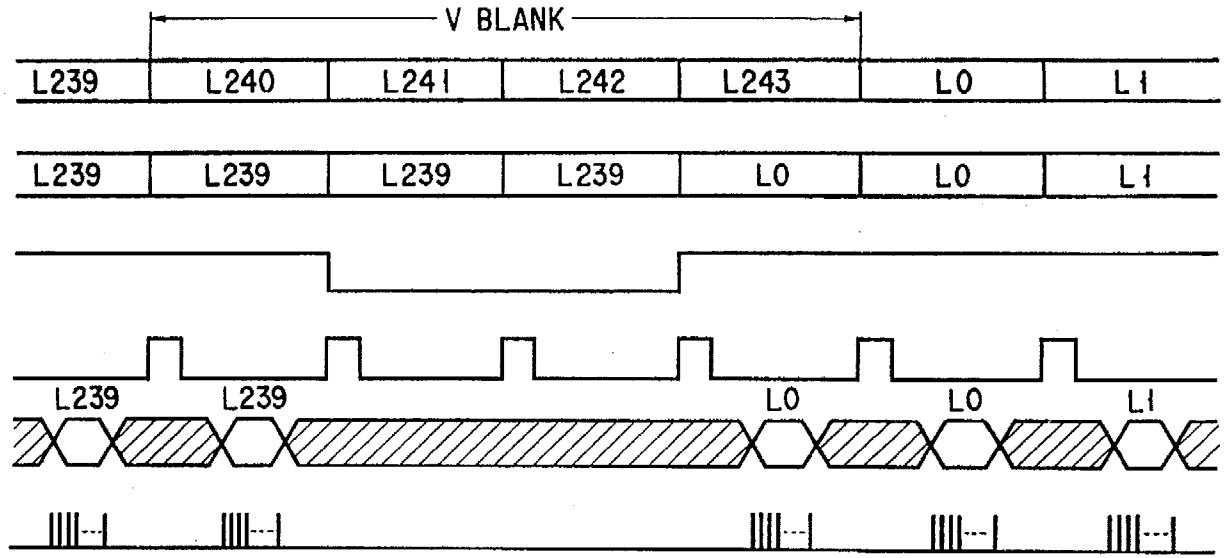
FIGS. 9A through 9F are timing charts for explaining the operation of the display controller shown in FIG. 8 when the flat panel display is controlled by the first method.

For this reason, on the start line (L240) of the vertical blank period, the same display data as that on the display final line L239 is read out from the VRAM 25, and the readout data is supplied to the video data converter 221 to be converted into flat panel video data FVD (FIG. 9E). The flat panel video data FVD is supplied to the flat panel display 40 together with the shift clock SCK (FIG. 9F). Therefore, dummy data which is the same as the flat panel video data on the display final line (L239) is fetched by the line buffer of the flat panel display 40.

Thereafter, when the line counter 171 indicates the final line (L243) of the vertical blank period, the address counter 151 starts the count operation, and outputs the start address of the display start line L0. The enable controller 152 sets the serial output enable signal SOE at active "H" level. For this reason, display data of the display start line L0 is read out from the VRAM 25, and is converted into flat panel video data by the video data converter 221. The flat panel video data is supplied to the flat panel display 40 together with the shift clock SCK. With this control, video data to be displayed on the display start line (L0) in the next frame cycle is output in advance as dummy data on the final line L243 of the vertical blank period, and is fetched by the line buffer of the flat panel display 40.

When the line counter 171 indicates the display start line (L0), the address counter 151 does not execute a count operation, and maintains the start address of the display start line L0. For this reason, display data on the display start line (L0) is read out again from the VRAM 25, and is converted into flat panel video data by the video data converter 221. Thereafter, the video data is supplied to the line buffer of the flat panel display 40.

In this manner, when the display controller 10 shown in FIG. 8 controls the flat panel display 40 by the first method, data of the display final line (L239) is read out successively twice from the VRAM 25, and data of the display start line L0 is also read out successively twice from the VRAM 25.

The operation of the display controller 10 shown in FIG. 8 which controls the flat panel display 40 by the second method will be described below with reference to the timing charts in FIGS. 10A through 10F, which respectively show the line counter, address counter, serial output enable SOE, latch pulse LP, video output FVD, and shift clock SCK.

Figures 10A, 10B, 10C, 10D, 10E, 10F:
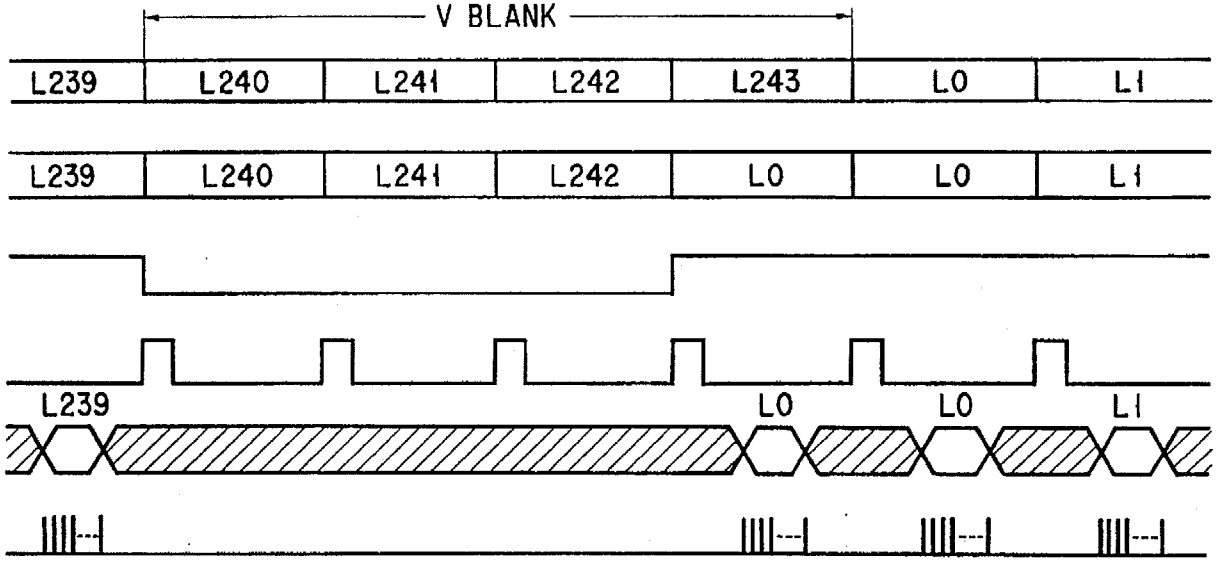
FIGS. 10A through 10F are timing charts for explaining the operation of the display controller shown in FIG. 8 when the flat panel display is controlled by the second method.

After the address counter 151 outputs the start address of the display final line (L239), the line counter 171 (FIG. 10A) indicates the start line (L240) of the vertical blank period (VBLANK). At this time, the enable controller 152 sets the serial output enable signal SOE (FIG. 10C) at inactive "L" level. The clock controller 222 stops generation of shift clocks SCK (FIG. 10F). When supply of shift clocks SCK is stopped, the line buffer of the flat panel display 40 keeps holding video data stored immediately before supply of shift clocks SCK is stopped. For this reason, video data of the display final line (L239) is maintained for a period of three lines (L240 through L242) from the start line of the vertical blank period.

With this control, video data of the display final line (L239) is set to be the same as that of the blank start line (L240).

Note that control for setting the same video data for the blank start line (L240) and the display start line (L0) is the same as that in the first method.

Figure 11:
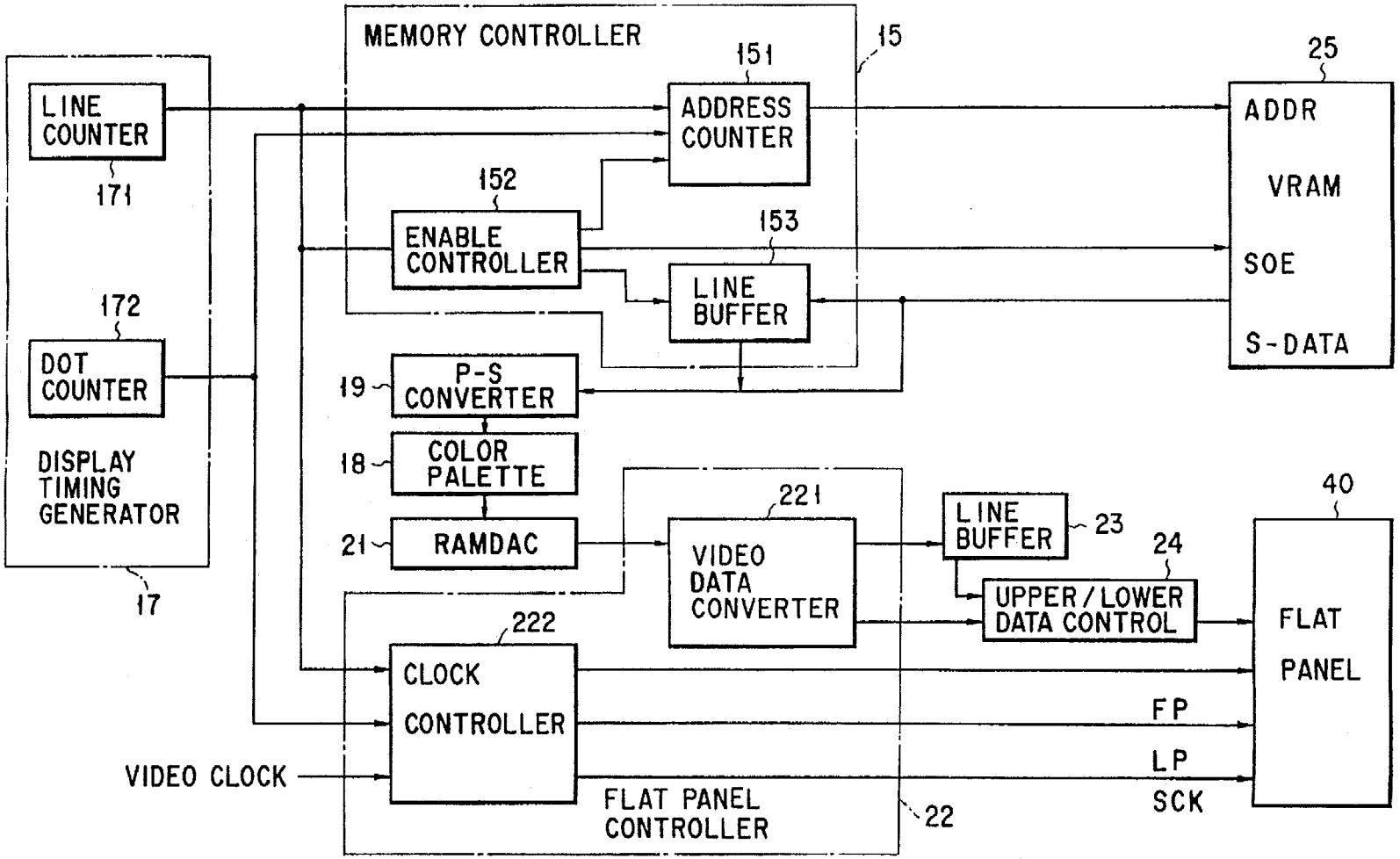
FIG. 11 is a block diagram showing a modification of the display controller shown in FIG. 8.
Figures 12A, 12B, 12C, 12D, 12E, 12F, 12G:
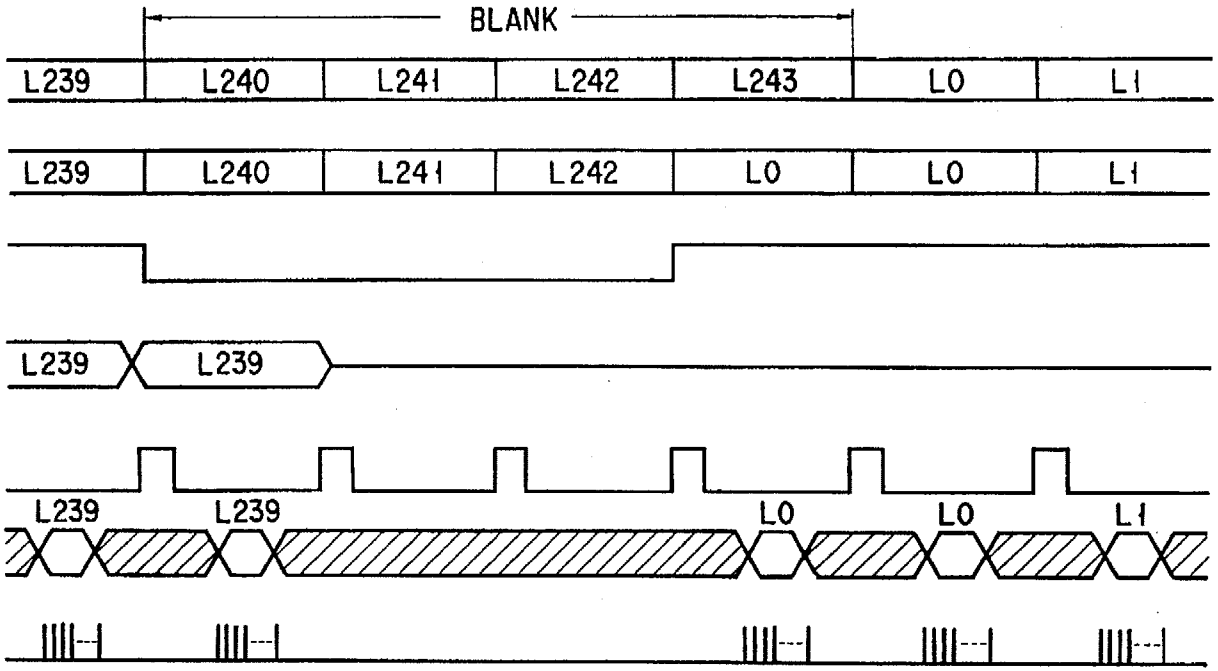
FIGS. 12A through 12G are timing charts for explaining the operation of the display controller shown in FIG. 11.

FIG. 11 shows a modification of the display controller 10 shown in FIG. 8.

In this display controller 10, only the arrangement of the memory controller 15 is different from the arrangement shown in FIG. 8. More specifically, in this arrangement, a line buffer 153 is added to the memory controller 15.

The line buffer 153 holds display data for one line. When the flat panel display 40 is controlled by the first method, the line buffer 153 is used for holding display data of the display final line (L239). The read/write control of the line buffer 153 is executed by the enable controller 152.

The operation upon control of the flat panel display 40 by the first method will be described below with reference to the timing charts in FIGS. 12A through 12G, which respectively show timing for the line counter, address counter, serial output enable SOE, line buffer, latch pulse LP, video output FVD, and shift clock SCK.

When the line counter 171 indicates the display final line L239, the write operation of the line buffer 153 is enabled. Thus, data of the display final line (L239) read out from the VRAM 25 is supplied to the P-S converter 19, and is also supplied to and written in the line buffer 153.

When the line counter 171 indicates the blank start line (L240), the serial output enable signal SOE (FIG. 12C) is stopped to stop the read operation from the VRAM 25. At this time, the read operation of the line buffer 153 is enabled to supply data of the display final line (L239) to the video data converter 221 via the P-S converter 19, the color palette 18, and the RAMDAC 21. In this manner, video data of the display final line (L239) is set to be the same as that of the blank start line (L240).

Note that the control operation for setting video data of the blank start line (L240) to be the same as that of the display start line (L0) is the same as that in the timing charts shown in FIGS. 9A through 9F.

As described above, in the display controller 10 of this embodiment, the contents of the line buffer in the panel of the display final line (L239) are set to be the same as those of the vertical blank period start line (L240) immediately after the display final line, and the contents of the line buffer in the panel of the display start line (L0) in the next frame cycle are set to be the same as those of the vertical blank period final line (L243) immediately before the display start line. For this reason, both upon a change from the display period to the vertical blank period and upon a change from the vertical blank period to the display period, a video data value difference can be eliminated, and a high-quality display free from noise lines displayed on the screen can be assured independently of data patterns to be displayed.

Note that the display controller 10 of the present invention is particularly suited for the flat panel display 40 constituted by the two, upper and lower panels. However, the present invention can also be applied to a flat panel display constituted by a single panel as long as the display can be controlled in a frame cycle including a vertical blank period. In this case as well, generation of noise lines on the upper and lower sides of the display screen can be prevented.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A display control apparatus for controlling a flat panel display with a frame cycle including a display period for a plurality of lines and a vertical blank period for at least two lines following the display period, said flat panel display being constituted by two display panels respectively corresponding to upper and lower halves of a screen, and said panels being simultaneously controlled in the frame cycle, comprising:

video data transfer means for sequentially transferring video data for a plurality of lines from a display start line to a display final line of said flat panel display to a line buffer of said flat panel display during the display period; and means for setting contents of said line buffer during the vertical blank period immediately after the display final line to be the same as video data of the display final line.

2. The apparatus according to claim 1, further comprising means for setting contents of said line buffer during the vertical blank period immediately before the next frame cycle to be the same as video data to be displayed on the display start line in the next frame cycle.

3. The apparatus according to claim 1, wherein said means for setting the contents of said line buffer to be the same as the video data of the display final line comprises video data re-transfer means for re-transferring the same video data as the video data of the display final line transferred by said video data transfer means to said line buffer of said flat panel display.

4. The apparatus according to claim 3, wherein said video data re-transfer means comprises means for repetitively reading out the video data of the display final line twice from a video memory which stores data for at least one frame.

5. The apparatus according to claim 3, wherein said video data re-transfer means comprises means for reading out the video data of the display final line from a video memory which stores data for at least one frame, a buffer for holding the video data of the display final line read out from said video memory, and means for re-transferring the video data of the display final line from said buffer.

6. A display control apparatus for controlling a flat panel display with a frame cycle including a display period for a plurality of lines and a vertical blank period for at least two lines following the display period, said flat panel display being constituted by two display panels respectively corresponding to upper and lower halves of a screen, and said panels being simultaneously controlled in the frame cycle, comprising:

video data transfer means for sequentially transferring video data for a plurality of lines from a display start line to a display final line of said flat panel display to a line buffer of said flat panel display during the display period;

shift clock supply means for supplying a shift clock for causing said line buffer to fetch the video data to said flat panel display in synchronism with the video data transferred from said video data transfer means; and means for stopping supply of the shift clock from said shift clock supply means to said flat panel display during the vertical blank period immediately after the display final line so that the video data of the display final line is held in said line buffer during the vertical blank period immediately after the display final line.

7. The apparatus according to claim 6, further comprising means for setting contents of said line buffer during the vertical blank period immediately before the next frame cycle to be the same as video data to be displayed on the display start line in the next frame cycle.

8. The apparatus according to claim 6, wherein said means for setting the contents of said line buffer to be the same as the video data to be displayed on the display start line in the next frame cycle comprises means for reading out in advance video data to be transferred to the display start line from a video memory which stores data for at least one frame, and transferring the readout video data to said line buffer of said flat panel display.

* * * * *